US005170832A

United States Patent [19]

Wagner

[11] Patent Number: 5,170,832

[45] Date of Patent: Dec. 15, 1992

[54] LIFT LINK GATE HAVING A PLURALITY OF TABULAR GATE ELEMENTS

[76] Inventor: Hugo Wagner, Kapuzinerstrasse 84e, Linz, A-4021, Austria

[21] Appl. No.: 605,507

[22] Filed: Oct. 30, 1990

Related U.S. Application Data

[63] Continuation-in-part of Ser. No. 312,611, Feb. 17, 1989, Pat. No. 4,989,660.

[30] Foreign Application Priority Data

Feb. 18, 1988 [AT] Austria ..... 391/88

[51] Int. Cl.[5] ..... E05D 15/06

[52] U.S. Cl. ..... 160/201; 160/229.1; 160/232

[58] Field of Search ..... 160/201, 40, 229.1, 160/232

[56] References Cited

U.S. PATENT DOCUMENTS

| | | | |
|---|---|---|---|
| 2,263,995 | 11/1941 | Katulski | 160/201 X |
| 2,300,265 | 10/1942 | Siess | 160/201 |
| 2,549,301 | 4/1951 | Ferrell et al. | 160/201 |
| 2,871,932 | 2/1959 | Stroup | 160/229.1 X |
| 3,103,967 | 9/1963 | Gaschen | 160/201 X |
| 3,148,724 | 9/1964 | Chieger et al. | 160/201 X |
| 3,198,242 | 8/1965 | Crosswell | 160/229.1 X |
| 3,941,180 | 3/1976 | Thill | 160/229.1 |
| 3,967,671 | 7/1976 | Stanley et al. | 160/201 X |
| 4,893,666 | 1/1990 | Hormann | 160/201 X |
| 4,989,660 | 2/1991 | Wagner | 160/201 |

*Primary Examiner*—David M. Purol

*Attorney, Agent, or Firm*—McAulay Fisher Nissen Goldberg & Kiel

[57] ABSTRACT

A lift link gate having a plurality of tabular gate elements joined together by joints or hinges about a horizontally extending pivot axis. The gate slides in lateral guide tracks which guide the gate from a vertically closed position along an arcuate path into a horizontally open position. To avoid finger injuries in the deflection area of the gate elements, there is provided at the upper edge of each gate element a tooth-like projection substantially symmetrical relative to the gate center plane which has a front flank ascending up to the tooth tip and a rear flank descending from the tooth tip to the rear face of one of the gate elements and at the lower upper edge at least one depression complementary to the projection of a next adjacent element is provided, and upon pivoting of the adjacent elements in the arcuate path area of the guide track, an aperture region is provided with only a small aperture spacing which precludes the wedging of a finger therein.

17 Claims, 4 Drawing Sheets

LIFT LINK GATE HAVING A PLURALITY OF TABULAR GATE ELEMENTS

CROSS-REFERENCE TO RELATED APPLICATIONS

This application is a continuation-in-part of U.S. patent application Ser. No. 312,611, filed Feb. 17, 1989, which has matured into U.S. Pat. No. 4,989,660.

BACKGROUND OF THE INVENTION

1. Field of the Invention

This invention relates to a lift link gate having a plurality of individual tabular gate elements joined together.

The invention is primarily concerned with the structure and configuration of the individual tabular gate elements forming the lift link gate. Each gate element is provided with an outer skin of stamped metal. The gate element is preferably formed from a pair of stamped metal pieces which are sealed together to prevent the entry of extraneous or undesirable moisture to the interior thereof whereby to prevent damage to the material within the interior of the metal outer casing.

The outer casing of the tabular gate element may also be formed from a single stamped metal which does not form a complete closure but which substantially surrounds the interior portion. This type of gate element is preferably used in interior areas where undesirable moisture and/or the entry of undesirable extraneous matter is not a problem. However, even though in some instances, moisture may be a problem, it can also be used outdoors.

More particularly, the invention is concerned with a plurality of tabular gate elements which are joined together by means of joints, hinges, or the like, about a horizontally extending pivot axis. Specifically, each pair of adjacent elements are joined together by the aforesaid joints, and the gate elements are provided with pins or rollers which are adapted to slide in lateral guide tracks for guiding the gate from a vertical or vertically closed position, then along an arc into a horizontally open position which is orthogonally related to the closed position. When the lift link gate element is formed from the individual gate elements, the outer configuration of each gate element for all positions of the lift link gate element is configured that the spacing between adjacent gate elements is such to prevent a wedging of a finger between adjacent gate elements.

The invention is also concerned with a tabular gate element having its outer facing protected by sheet metal shells which can be preformed as half-shells and then snapped together to provide for a complete metal outer covering.

The tabular gate element may also be formed so that its outer facing is made from a single element which is larger than the half-shells but does not provide for a complete outer covering.

2. Description of the Prior Art

When the gate elements move from a vertical to a horizontal position, the adjacent gate elements have their spacing therebetween changed so that upper and lower edges of respective adjacent gate elements are spaced from each other in accordance with a mutual tilt and, as the gate elements come together along the arc, the rear end of one gate element approaches the front end of the next adjacent gate element and the fingers of a user may be wedged in and dangerous injuries may result. Examples of prior art in which this type of difficulty exists are those such as set forth in Stroup, U.S. Pat. No. 2,880,796, Giertsen, Federal Republic of Germany DE-OS 1509191.

The prior art has also proposed various solutions which while usable for other purposes can also be considered to avoid the wedging of a finger between adjacent gate elements, and yet none of these appear to be satisfactory. One suggested possibility for avoiding such injuries is disclosed in Austrian AT-PS 382,432. According to the disclosure of the Austrian publication, and other examples like it, specific edge sections are used to provide for a hinge-type joining of the gate elements, so that there remains at a front face of the closed gate, a distance between the upper and lower edges of adjacent gate elements, respectively; this is of a size generally to preclude the pinching of a finger. The disadvantage of the aforesaid heretofore known lift link gate is that the edge sections used are relatively costly and the closed gate has on its outer face inwardly recessed horizontal grooves which often are undesirable for aesthetic reasons.

The prior art has also provided for mutually facing edges of gate elements, a step so as to provide for a better heat insulation in the region of the closure (see, for example, Dover, Federal Republic of Germany DE-OS 2106063, Austrian AT-PS 369129). While these steps can improve the heat insulation, they do not help to avoid the danger of finger injuries.

During the prosecution of the parent application, Ser. No. 312,611, applicant became aware of U.S. Pat. No. 3,942,180 to Thill. This patent while providing for a spacing in certain positions of operation does not provide for a spacing which also helps to prevent the wedging of a finger or digit between the tabular gate elements. Moreover, in this patent, it is only possible to manufacture the outer metallic components or skin when the skin is made from aluminum and not steel because of the non-smoothly curving bends required of the metal.

Also cited was Crosswell, U.S. Pat. No. 3,198,242 which shows a recess that is not completely enclosed or protected from atmospheric elements by metal. A mating seal is provided to close the spacing between adjacent elements but a digit or finger is not prevented from being clamped.

There is other prior art known to the inventor from the parent application, Ser. No. 312,611. Specifically, reference is made to U.S. Pat. No. 3,198,242 to Crosswell which relates to an upwardly acting door which shows a depression in a first member complementary to a tooth-like projection in a second member and provided with resilient seal members in an attempt to prevent a portion of a limb from entering between the two members. In addition, Crosswell does not teach the use of two sheet metal shells independently formed. Crosswell has two outer plates held together by means of screws screwed into an intermediate section formed of a wood core or other insulating material to form a sandwich construction with the outer plates.

SUMMARY OF THE INVENTION

It is an object of the invention to provide lift link gate elements which for exterior use can be protected by a metallic skin formed from two elements which are sealed to each other to prevent entry of undesirable extraneous matter or undesirable moisture to the interior.

It is another object of the invention to provide a lift link gate formed from lift link gate elements wherein a good seal between the adjacent gate elements exists and finger injuries in the deflection area of the gate elements can be avoided as the spacing between adjacent gate elements increase and decrease as the gate elements traverse their normal path.

This objective can be achieved with a lift link gate of the initially mentioned kind wherein, according to the invention, and considering movement in a first or upward direction at an upper edge of each gate element, there is provided a tooth type projection substantially symmetrical relative to the gate center plane which has a front flank ascending to the tip of the tooth and a rear flank descending from the tip of the tooth to the rear face of the element. And, at the lower edge, at least one depression adapted to the projection of the adjacent element is provided, so that upon tilting of the elements in the arc region of the guide tracks between the vertical and horizontal orientation of the tracks only an aperture spacing is provided which precludes and effectively prevents the wedging therein of a finger.

The gate elements have been described in such a manner that the tooth projection is on the trailing adjacent link. The tooth projection could very well be at the bottom of the leading adjacent link. Therefore, it is within the scope of the invention to provide the lower edge of each gate element with a tooth-type projection substantially symmetrical relative to the gate center plane which has a front flank descending to the tip of the tooth and a rear flank ascending from the tip of the tooth to the rear face of the element. And, at the upper edge, at least one depression is adapted to the projection of the adjacent element so that, upon tilting of the elements in the arc region of the guide tracks between the vertical and horizontal orientation of the tracks, only an aperture spacing is provided to prevent the wedging therein of a finger.

The gate element is preferably formed from a pair of stamped metal pieces which are sealed together. In a further preferred embodiment, the stamped metal pieces are identical to facilitate assemblage and reduce manufacturing costs.

In accordance with the invention, when the lift link gate element is made with an outer metal coating or skin, a snap connection is provided at the depression and the projection to lock the two portions of the outer metallic skin together.

It is also possible to weld the two outer metal coatings or skins together to provide a water-tight moisture seal as well as a seal against dirt.

The outer casing of the tabular gate element may also be formed from a single stamped metal which does not form a complete closure but which substantially surrounds the interior portion. This type of gate element can be used in particular in interior areas where undesirable moisture and/or the entry of undesirable extraneous matter is not a problem.

According to the invention, the new form of the upper and lower edges of the gate elements makes it possible to place the pivot axis so that in the arc region of the guide tracks only a small aperture spacing or aperture results between adjacent gate elements, for example, a spacing of 4 mm as a maximum, so that fingers cannot inadvertently get into the aperture region. Moreover, with the present invention, the ascending front face additionally brings about that fingers engaging in the aperture region slip off easily and do not "get stuck" in a dangerous part of the aperture region. The tooth system between the gate elements results not only in a good seal in the closed state, but also in a centering effect which helps to compensate tolerances of the elements and/or their lateral guides. Further, a good mutual support of the elements exists, which comes into play especially when individual elements are weakened by glass window openings. The symmetrical design leads to a simplified production, especially when each element is made of two sheet metal shells, as these can then be of identical form.

Further, in addition to the small aperture between adjacent link elements, a recess is provided which is formed by the two adjacent link elements which is larger than the aperture, but entry of a finger into the aperture is prevented because of the small spacing.

To these ends, the invention comprises a lift link gate for use with lateral guide tracks, including a plurality of tabular gate elements joined together by hingedly connected joints with each of the hingedly connecting joints extending about a horizontally extending pivot axis, each said gate element having a front face and a rear face; guides coupling the gate elements for sliding movement in the lateral guide tracks for guiding the lift link gate in a vertically direction out of a vertically closed position along an arc path region into a horizontal direction to a horizontal open position; and, in a first direction of movement, an upper edge of each gate element except the leading gate element includes at least a tooth-like projection substantially symmetrical relative to the gate center plane and having a tooth tip and front flank ascending from the front face up to the tooth tip and a rear flank descending from the tooth tip to the rear face of the gate element; each gate element at the lower edge thereof, except the last gate element, having at least one depression complementary to the projection of a next adjacent gate element for receiving therein the projection of the adjacent element; and an aperture region provided between the adjacent elements which aperture region provides an aperture spacing precluding the wedging of a finger therein, upon pivoting of any two adjacent elements in the arc path region of the guide track.

The tabular gate element may also be formed so that its outer facing is made from a single element which is larger than the half-shells but does not provide for a complete outer covering.

BRIEF DESCRIPTION OF THE DRAWINGS

In order that the invention will be more readily understood, the same will now be described in connection with the accompanying drawings in which.

DESCRIPTION OF THE PREFERRED EMBODIMENTS

Figure 1:
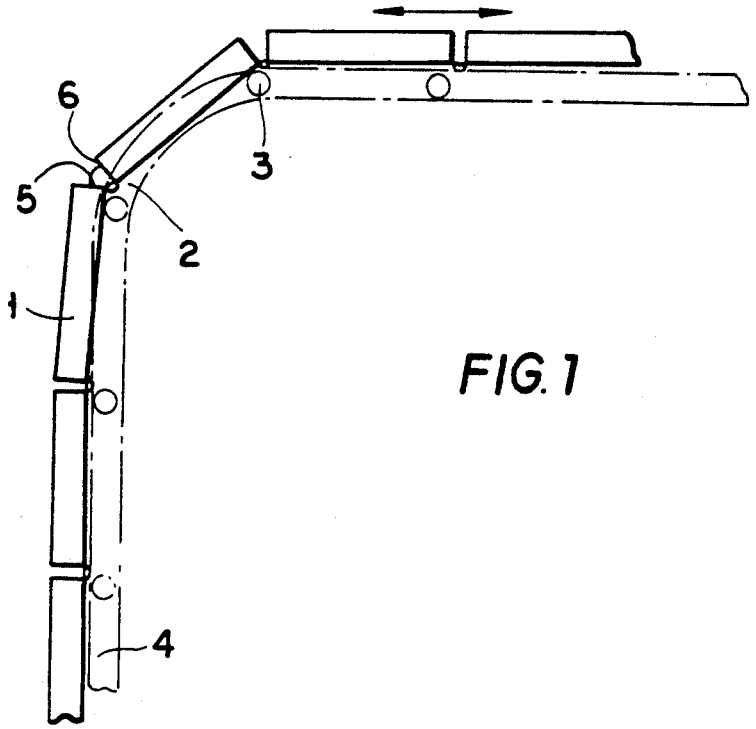
FIG. 1 is a schematic side view of a portion of the vertical track and horizontal track together with the arc region joining the vertical and horizontal tracks and the means guiding the gate elements of a lift link gate in the arc region between the vertical and horizontal tracks.

Referring now more particularly to FIG. 1 of the drawing which illustrates a presently preferred mode for carrying out the invention, there is shown a lift link gate generally consisting of at least two and preferably a plurality of individual gate elements 1 which are joined together by means of hinges, joints or the equivalent 2; the respective pivot axis a of each joint 2 extends horizontally. Coupled with hinges or joints 2 are guide rollers 3 which are guided along lateral guide rails 4 or similar guide tracks.

In the gate opening area, guide rails 4 are shown as extending in a vertical direction and change over along an arc portion or region to a horizontal portion. In order to close the gate, the interconnected adjacent elements 1, 1' are brought from the horizontal rail portion into the vertical portion. As can be seen from FIG. 1, in accordance with the mutual tilt of the gate elements 1, 1', their adjacent upper and lower edges 5, 6 of adjacent gate elements are spaced from each other in a wide open manner or agape to form a gap between adjacent gate elements. If, during the closing movement of the gate, the fingers of a user get into the respective gap in prior art gate elements, the fingers may be wedged in, as the edges come together again in the course of the closing movement. This invention prevents the fingers from becoming wedged in.

The movement of the gate may be controlled either manually or it may be motorized. It should also be understood that like or similar parts in all of the various embodiments are designated with the same reference numeral.

Figure 2:
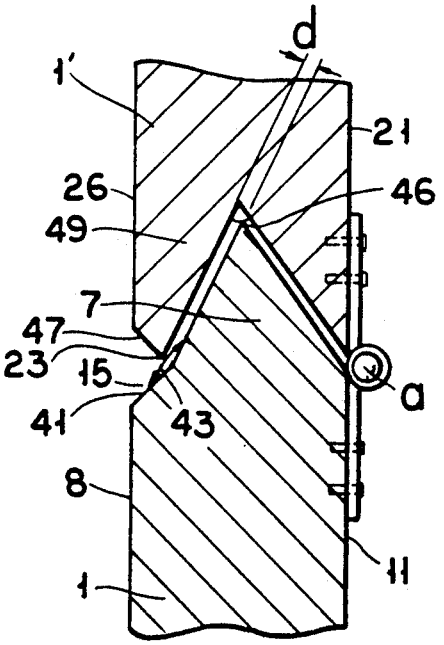
FIG. 2 is a schematic sectional view of one embodiment of two adjacent gate elements of a lift link gate according to one embodiment of the invention shown in their position when travelling along a straight portion of the vertical or horizontal track and the joint element joining the two adjacent gate elements.
Figure 3:
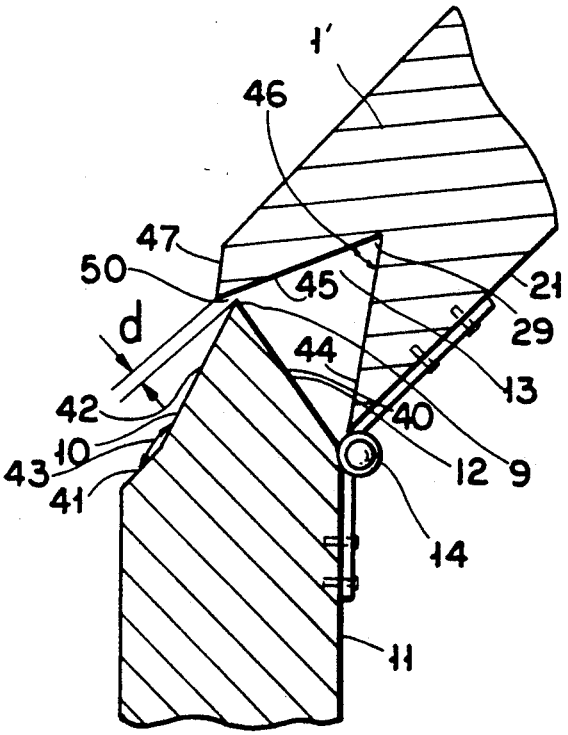
FIG. 3 is another view of the two adjacent gate elements of the lift link gate shown in FIG. 2 with the adjacent gate elements somewhat displaced from each other and pivoting about the hingedly connected joint to indicate their position in the arc region joining the horizontal and vertical track portions, with the two adjacent elements tilted relative to each other so as to enable them to move along the arc region.

Referring now more particularly to FIGS. 2 and 3, two adjacent gate elements are shown with the upper gate element designated as 1' and the lower gate element designated as 1. The lower edge of lower gate element 1 will be the same as the lower edge of its next adjacent upper gate element 1' and is not shown. In a similar manner, the upper edge of upper gate element 1' is the same as the upper edge of gate element 1. Accordingly, reference numerals 1 and 1' have meaning only when discussing two adjacent gate elements.

In the embodiment of FIGS. 2 and 3, each gate element 1 has at its upper edge 5 an upwardly extending projection 7 having a cross-section; and, in the present invention, it is shown as a triangular cross-section. The projection 7 has a front face 8, a tooth tip 9 and a front flank 10 originating from the front face 8 of element 1 and ascending up to the tooth tip 9. Tooth projection 7 comes to a point at tip 9. Gate element 1 has a rear face 11 similar to front face 8 and a rear flank 12 descending from the tooth tip 9 to the rear face 11. At the lower edge 6 of the adjacent element 1' as shown, and also at the portion of element 1 itself (not shown), a depression 13 is provided whose form is adapted to and complementary to the projection 7. The terms "top" and "bottom" used in the specification and claims in connection with the gate elements refer to the gate in its closed position, i.e., when the elements are in their vertically extending position.

Rear flank 12 has a surface 40 (a first surface) and front flank 10 is composed of two surfaces 41, 42 and included angle 43 which is greater than 90 and less than 180°. Surface 41 is a second surface and surface 42 is a third surface which form the two sides of included obtuse angle 43. Surface 41 also forms a bevel as explained hereinafter.

Adjacent element 1' includes a front face 26 substantially coextensive with front face 8 of element 1, and rear face 21 substantially coextensive with rear face 11 of element 1 in the closed condition of the gate elements and extends from a not shown tip forming one end of surface 44 forming one side or a rear surface of depression 13, surface 45 forming the other side of or a front surface of the depression 13.

Surfaces 44 and 45 form fourth and fifth surfaces with an included acute angle 46. The fourth surface 44 is complementary to the first surface 40 and the fifth surface 45 is complementary to the third surface 42.

Hinge 14 is provided for connecting elements 1, 1' together. Hinge 14 is fastened by straps to one of the elements 1, 1'. As best seen in FIG. 3, upon tilting of the elements 1, 1' so that they are not vertically aligned, there results in the arc region of the guide rails 4 a maximum tilt angle of about 60° or an included angle of about 120° between rear face 11 and rear face 21; and between tip 23 formed at the juncture of a bevelled or sixth surface 47 and the surface 45, there is an included acute angle or an outside obtuse angle between the fifth surface 45 and the sixth surface 47.

The distance or spacing between surface 42 on element 1 and surface 45 on element 1' is such to form a spacing sufficient only for the two elements to rotate relative to each other about pivot axis a. This spacing is defined only as an aperture region including an access portion or recess between surfaces or bevels 41 and 47, and an aperture or clearance portion 49 (as shown in FIG. 2) and 50 (as shown in FIG. 3) having a small or open aperture spacing d between upwardly extending projection 7 and front inner surface 45 forming one side edge of depression 13 and tooth tip 9, which, e.g., by varying the position of the horizontal pivot axis a of the hinges 14 is adjustable to about 4 mm. The open aperture spacing d is about 4 mm to prevent wedging of a finger thereinto. This small spacing 49 (FIG. 2) which is the same as 50 (FIG. 3) of 4 mm whether in the closed condition of FIG. 2 or the open condition of FIG. 3 prevents fingers of a user from getting into the area or volume in between the edges or surfaces of adjacent elements and becoming injured; this effect is supported by the ascending flank 10 along which the fingers of a user slide off.

By bevelling the lower edge of one side of the depression remote from the hinged portion 14 to form bevelled surface 47 as well as the lower portion of the upwardly extending projection 7 to form bevelled surface 41, there is formed the recess 15 which forms part of the aperture region. Recess 15 is of sufficient width to avoid and thereby to prevent wedging of a finger therein whether in a closed condition as in FIG. 2 or an open condition as in FIG. 3; and in the closed condition shown in FIG. 2, the spacing or clearance portion 49 between surfaces 42 and 45 is the same as the small aperture spacing d as shown at 50 in FIG. 3 to prevent the wedging of a finger therebetween in the aperture or clearance portion 50. Accordingly, as can be seen from FIGS. 2 and 3, because of the corresponding bevels 41, 47 of the two adjacent gate elements, there remains in a closed position the recess 15 in the region of the closure of the adjacent elements 1, 1' on the front side. Recess 15 additionally improves the appearance of the closed gate. Recess 15 has a triangular configuration and if the front and rear of elements 1, 1' are formed substantially identically to each other, there is room on the rear to receive a portion of the hinge.

Figure 4:
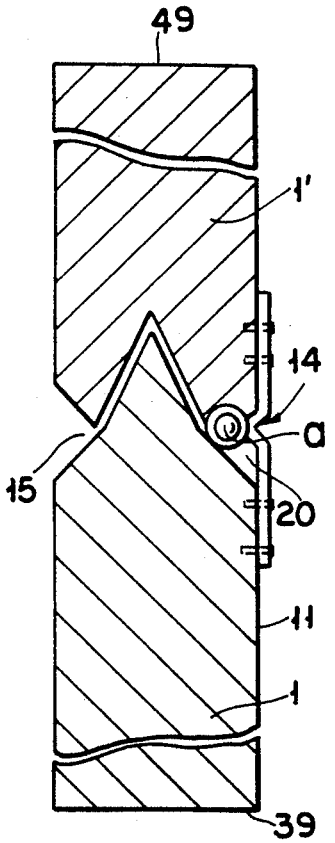
FIG. 4 is another embodiment which is a modification of the lift link gate of FIG. 2 showing two adjacent gate elements together with a different hingedly connected joint means joining the two adjacent elements.

Referring now more particularly to FIG. 4, another embodiment is shown in which a further recess 20, at the rear of elements 1 and 1', is provided in addition to recess 15. Recess 20 may be of the same size as recess 15 with bevels 41 and 47 so that the gate elements can be used interchangeably front and rear, or recesses 20 and 15 can be different so that one side forms a rear side and the other side forms a front side. Rear or further recess 20 is provided so that it can receive the joint of hinge 14, such that the pivot axis a lies in front of the rear faces 11, 21 of the elements 1, 1', respectively. In all other respects, this embodiment with elements 1, 1' is generally similar to the embodiment shown in FIGS. 2 and 3. With hinge 14 in recess 20, less space is required for the width of the links or a connection linking of the two gate elements 1, 1'. Recess 15 and open aperture spacing d as shown at 49, 50 still perform the same function as described in connection with the FIGS. 2–3 embodiment. The hinge 14 in recess 20 is not exposed so that a finger would not be wedged therein.

Figure 5:
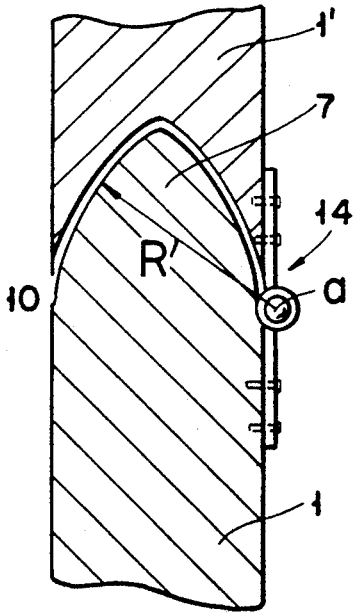
FIG. 5 is a further modification showing another embodiment of two adjacent gate elements with a hingedly connected joint means similar to the joint means of FIGS. 2 and 3, but with a modified mating portion.

Referring now more particularly to FIG. 5 of the drawing which shows a modification of the tooth-shaped upwardly extending projection 7, in this embodiment, both the front and rear flanks of projection 7 curve along an arc of a circle. A radius of curvature R is shown for the front flank, and this radius of curvature has its center located at the pivot axis a in hinge or joint 14.

When the center of curvature or radius of curvature R coincides with the pivot axis a, there will be during the pivoting movement of the elements 1, 1' no change at all in the distance between the front flank 10 of the projection of an element 1 and the associated depression 13 of the adjacent element 1', so that when taking manufacturing tolerances into consideration this distance can be minimized practically ad libitum.

Figure 6:
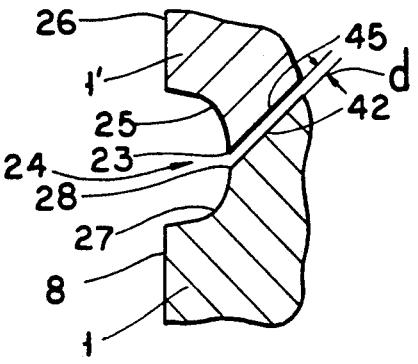
FIG. 6 is a modification of the embodiment of the embodiment of FIG. 2 and shows a modified recess.

Referring now to FIG. 6 which shows a modified recess 15, having a semi-rounded cross-section recess 24 provided with a first partial rounded surface 25 and a second partial rounded surface 27. First partial rounded surface 25 is connected with front face 26 at one end, and at its other end the partial rounded surface is connected with tip or apex 23 and front inner surface 45. Second partial rounded surface 27 is connected with front face 8 at one end thereof and with surface 42 of upwardly extending projection 7 to form recess 24. Second rounded surface 27 and surface 42 meet at apex or tip 28. The small aperture spacing between tips 23 and 28 is the same as aperture spacing d to prevent wedging of a finger therein and as explained in connection with aperture region 49, 50 in FIGS. 2 and 3. The spacing d does not exceed 4 mm.

Figure 7:
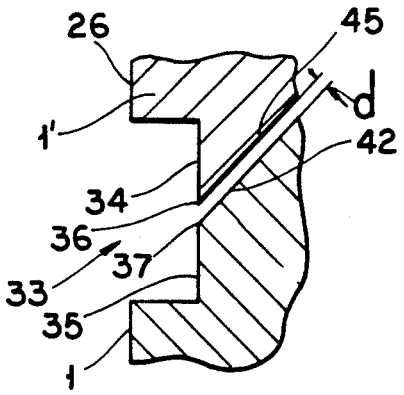
FIG. 7 is another embodiment showing a further modification of the recess.

Referring to FIG. 7 which shows a further modification of recess 15, having a substantially U-shaped angled recess 33 formed from a partial or quarter rectangular cross-section comprised of angled parts 34 and 35. Tips or apexes 36 and 37 are similar to tips or apexes 23 and 28, respectively so that angled part 34 is connected at one end to the surface of front face 26 and at its other end to surface 45. Angled part 35 has one end connected with the surface of front face 8 and its other end connected with surface 42. In this embodiment the rectangular cross-section 33 performs the same function as recess 15 and the small aperture spacing between surfaces 42 and 44 is the spacing d.

Open aperture spacing 49, 50 defined by spacing d in FIGS. 2 and 3 is provided between the third surface 42 and the fifth surface 45 to prevent a finger from becoming wedged therein, and at the termination of surface 42, bevelled surface 41 is provided as a connection to front face 8 to provide with bevelled surface 47, the recess 15 provide a spacing sufficiently wide to avoid a finger from becoming held or wedged between elements 1 and 1', respectively.

It should be noted that the elements 1, 1' may be pivotably interconnected by the usual hinges or by special shaped sections as disclosed in U.S. Pat. No. 2,880,796. It is possible also, however, that the pivoting connection between the elements is brought about only laterally, next to the gate opening or respectively in the rail region by special straps or the like. Such a design, which is possible because of a good support of the elements formed according to the invention, is recommended for correspondingly rigid elements or respectively not overly wide gates. The elements themselves may be double-walled with or without insulation, single-walled, e.g., of sectional sheet metal, or solid, e.g., of wood or plastic or in composite construction.

It is also possible for the lower edge of the bottommost gate element 1, as shown in FIG. 4 to be generally flat as at flat surface 39, but it need not be so. The same also applies to the upper edge of 49 which is formed as a flat surface for the upper gate element 1' as shown in FIG. 4. On the other hand, to simplify manufacture, the bottommost and the topmost gate element may be identical with the other elements. It is also possible to use the elements upside down or reversed, i.e., e.g., in the embodiment according to FIGS. 2 and 3 with projection 7 extending in a downwardly direction, although such a design is inappropriate if splash water and condensation may occur.

Figure 8:
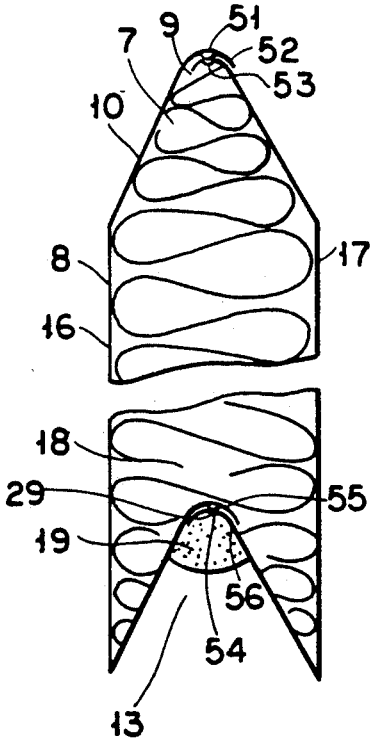
FIG. 8 is a view of another embodiment of the gate element shown in FIG. 2 and is a modification of a single gate element shown partially in section and partially schematically.

Referring now to FIG. 8, there is shown a single gate element 1 which consists of two sheet metal shells 16, 17 with an inserted insulation 18 enclosed by the two sheet metal shells. This insulation 18 is either glued to the sheet metal shells 16, 17 or it is introduced into the sheet metal shells by foaming. This results in a high stability of element 1 combined with low weight. As can be seen, the sheet metal shells 16, 17 may be of identical design, thereby simplifying their manufacture. The connection between the sheet metal elements 16, 17 may alternatively be by means of a snap connection 51 schematically shown with curved portion 52 of sheet metal shell 16 overlying curved portion 53 of sheet metal shell 17. While only a single gate element 1 is shown, it is to be understood that each gate element 1 is usable with another similar gate element as described in connection with the FIGS. 2 and 3 embodiment. Element 1, like the one in the FIGS. 2–3 embodiment, has at its upper edge a triangular projection 7 and at its lower edge a corresponding depression 13. As shown, for this element, in gore 29 or base of depression 13 associated with tooth tip 9, there is provided a seal strip 19 extending over the total width of the element which may be inserted into the gore and it may be glued in the gore 29. Seal strip 19 consists of an elastic, soft plastic material which both improves the heat insulation at the joints of the elements and counteracts the penetration of moisture.

Sheet metal shells 16 and 17 at the depression 13 in the gore 29 is also provided with a snap connection 54 which is similar to or the same as snap connection 51. The snap connection 54 comprises overlying curved portions 55 and 56 on shell 16 and 17, respectively. In this embodiment, the snap connection is shown such that overlying portion 52 of shell 16 overlies and snaps into overlying portion 53 of shell 17, and overlying portion 55 of shell 16 snaps into portion 56 of shell 17 and both snap connections 51 and 54 cooperate with both tip 9 and depression 13 to hold the half shells together. The snap connection is such that it does not make any difference whether curved portion 55 overlies curved portion 56 or vice versa.

Figure 9:
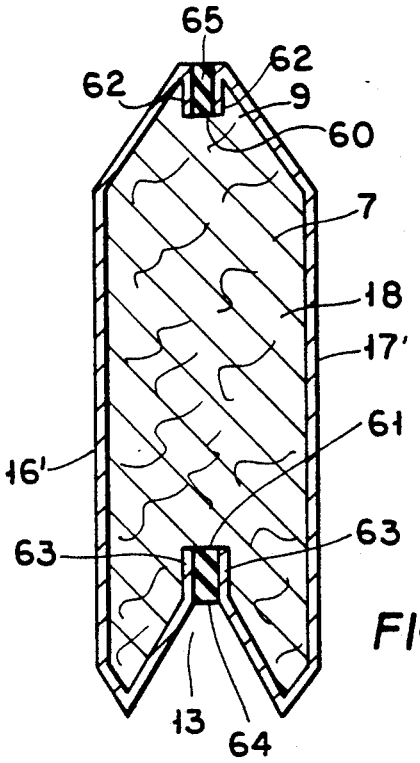
FIG. 9 is a view of another embodiment of the gate element shown in FIG. 8, partially in section and partially schematically.

Referring now to FIG. 9 which shows an insulation, preferably foam insulation 18 provided within metal shells 16', 17' and provided at tooth tip 19 with a transverse U-shaped or angled opening 60 and a similar or the same type of opening 61 in the depression 13. The outer covering for the insulation is formed from two sheet metal shells 16' and 17', each having an inwardly directed member 62 extending therefrom into U-shaped transverse opening 60. The sheet metal shells 16', 17' are provided with inwardly directed members 63 extending into U-shaped transverse opening 61 in depression 13 and provided with sealing member 65 to seal opening 61. At depression 13, each of the half shells 16', 17' provided with vertically extending member portions 63 extending into opening 61 forms together with insulation 64 which is positioned between member portions 63 to seal the foam insulation 18 from the outside atmosphere and provide a tight fit with portions 63 in opening 61 for holding them therein. Also, a similar sealing member 65 is provided to fit between members 62 to provide a tight seal in transverse or U-shaped opening 60.

Metal shells 16' and 17' provide a tight fit onto foam insulation 18 and conform to the outer portion thereof. The members 62 and member portions 63 together with seals or insulators 64 and 65 provide a tight fit and assist in holding shells 16' and 17' onto the foam insulation 18. Once the foam insulation hardens, a U-shaped or transverse opening 66 forms in foam insulation 18 for receiving inwardly directed members 62 at 60, and another U-shaped or transverse opening forms in foam insulation material 18 for receiving inwardly directed member 63 at 61.

Foam 18 (e.g., polyurethane foam) is inserted into shells 16', 17'. This is accomplished by means of a tube (not shown) which is inserted on a lateral edge of the element. The shells are held in a mold during foaming and the foam adheres to the entire inner surface. Openings 60, 61 are sealed when the entire unit is assembled. The spacing between the adjacent ends 62, 63 can be about 2 mm, but these are sealed. Sealing member 64, 65 serve as a seal or thermal break so that the complete opening is filled.

Figure 10:
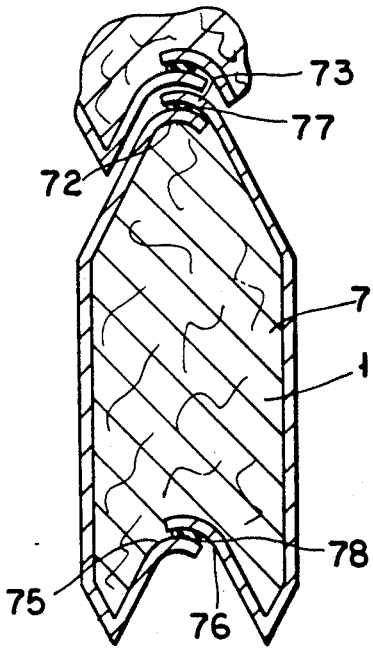
FIG. 10 is a view of another embodiment of the gate element shown in FIG. 8, but using a snap connection with an intermediate insulating strip between the adjacent overlapping ends forming the snap connection with the insulating material therebetween.

Referring now more particularly to FIG. 10 which is generally similar to FIG. 8 and shows foam insulation 18 sandwiched between curved portions 72 and 75 forming the ends of shell 16. Curved portions 73 and 76 of shell 17 overlie curved portions 72 and 75 respectively with seal or insulating strips 77 and 78 being sandwiched between curved portions 72, 73 and curved portions 75, 76, respectively. Curved portions 73, 76 form a snap connection with curved portions 72, 75 and hold the two shells 16, 17 together. In this embodiment, the curved portions 73, 76 overlie the curved portions 72, 75 to provide an effective spring holding of the two shells 16, 17 onto insulation 18.

The embodiments shown in FIGS. 8, 9, and 10 which show double-walled elements 16, 16' and 17, 17' may be made from aluminum.

Figure 11:
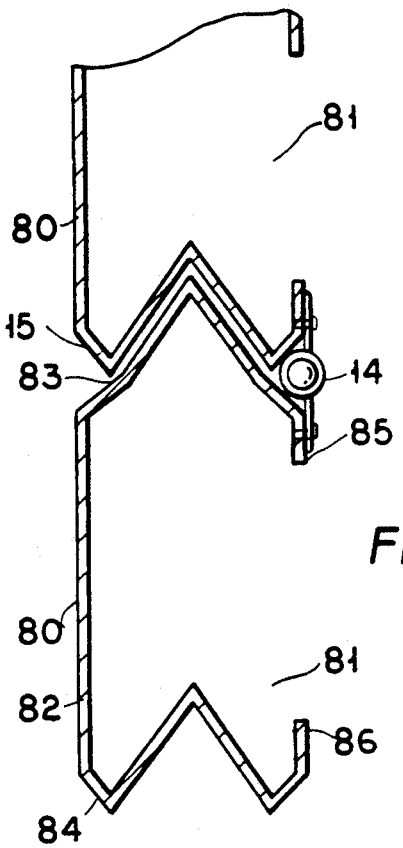
FIG. 11 is a view of another embodiment of the gate elements shown in FIG. 2, each formed form a single open stamped element.

Referring now to FIG. 11 which shows a single partial shell enclosure 80 which can be used to cover an insulating member such as foam 18 or left as an open core 81 as shown. Each shell is formed from springy steel so that it can retain its shape even though it has no internal core and no foam 18 is used.

Each shell 80 includes a substantially U-shaped portion having a base 82 forming one side and a first leg portion 83 forming the apex 7 and a second leg portion 84 forming the depression 13. Leg portion 83 is provided with a first end 85, and leg portion 84 is provided with a second end 86. An opening is formed as a spacing between leg portions 85 and 86 leaving the portion between leg portions 85 and 86 open. Between ends 85 and 86, the opening provides access to the open core 81. Ends or leg portion 85 and 86 can be secured by connecting elements, such as screws, to hinge 14.

The recesses, such as 15 in FIGS. 2, 3, 4; 24 in FIG. 6; 33 in FIGS. 7 and 11, provide a safety factor as well as an aesthetical effect on a front side of the gate, and at the same time, serves to accommodate the hinges as shown in FIGS. 4 and 11. When they are made of the same size, they can be used interchangeably to assemble the gate.

Moreover, if the hinges are placed into the recesses, then the hinges are closer to the center plane or plane of symmetry of the gate elements, which is advantageous to the kinematics of the gate.

The outer shells are preferably made from steel, but aluminum can also be used, and the teachings of this invention applies equally well to aluminum as to steel. It is also within the scope of the invention to have the interior hollow and for the purposes of the invention, foam, as noted, is used in the interior of the shells to fill the spacing therein. For certain purposes, the elements may be made as in FIG. 11 where a portion of the rear is left open and no foam insulation is used.

Figure 12:
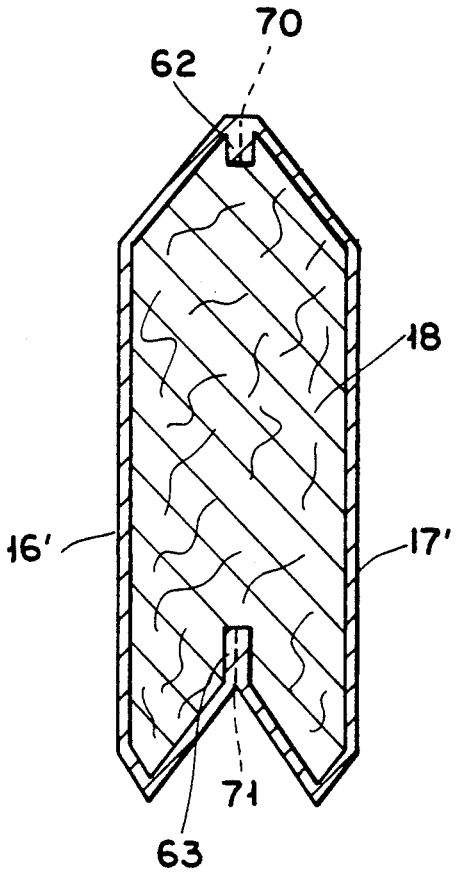
FIG. 12 is a partial showing of a view of another embodiment which is similar to the embodiment of FIG. 9, but showing the elements welded together.

Referring now to FIG. 12, outer shells 16', 17' are welded at 70 to weld the inwardly directed members 62 together. Members 62 are at the top and extend vertically downwardly. Inwardly directed members 63 which extend vertically upwardly are also welded together at 71. Both welds 70, 71 take place after the foam insulation 18 is inserted into the space between shells 16', 17' which are held in the mold during the insulation of the foam.

The embodiments formed from two sheet metal shells can be fabricated with snap connections. Fabrication from steel is also easily accomplished such that each gate element comprises two formed sheet metal elements and connection means joining the sheet metal elements together by means of the snap connection or by welding. When formed of two sheet metal shells, it is preferred that insulation be provided therebetween to assure sealing where this is desired.

While there has been shown what is presently considered to be the preferred embodiments of the invention, it will be obvious to those skilled in the art that various changes and modifications may be made therein without departing from the scope of the invention.

I claim:

1. A lift link gate having a plurality of tabular gate elements joined together on their back sides by hinge means with each said hinge means extending about a horizontally extending pivot axis for use with lateral guide tracks and guide means coupling the gate elements for sliding movement in said lateral guide tracks for guiding said link gate out of a vertically closed position in a vertical direction and then along an arcuate path region and then in a horizontal direction into a horizontal open position, comprising:

each said gate element including a front face and a rear face, and in a first direction of movement in the vertical direction an upper edge of each said gate element includes a tooth-like projection extending from said front face up to said next adjacent gate element in said first direction of movement in the vertical direction and substantially symmetrical relative to a gate center plane and having a tooth tip, a rear flank, and a front flank ascending up to said tooth tip, said rear flank descending from said tooth tip to said rear face of said gate element;

each said gate element having at a lower edge thereof in a direction opposite to said first direction of movement at least one depression complementary to said tooth-like projection of a next adjacent gate element for receiving therein said projection of said next adjacent element in said first direction of movement in the vertical direction and substantially symmetrical to a gate center plane, said projection of next said adjacent element having a tooth tip in conformity with said tooth-like projection, said depression being complementary to said tooth-like tip;

each of said gate elements comprising two substantially identically formed sheet metal shells;

connection means for connecting said sheet metal shells together including inwardly directed members at each end of said substantially identically formed sheet metal shells and sealing members for forming a seal between said inwardly directed members at each end of said sheet metal shells; and an aperture region provided between complementary portions of said adjacent elements and including an open aperture spacing precluding the wedging of a finger therein but sufficient for said two gate elements to rotate relative to each other about said hinge means.

2. The gate as claimed in claim 1, wherein said rear flank has a first surface, said front flank has a second surface and a third surface forming two surfaces with an included obtuse angle therebetween with sides, said second and third surfaces forming sides coextensive with said first surface of said rear flank; said depression having a fourth and a fifth surface with a first included angle therebetween and a sixth surface forming a second angle with said fifth surface and having a second included angle smaller than said first-mentioned included angle.

3. The gate as claimed in claim 2, wherein said aperture spacing is formed by said third surface and said fifth surface which are in a non-parallel condition relative to each other upon pivoting of said two adjacent elements in said arcuate path region of the guide track and which are in a parallel condition when said two adjacent elements are in said vertically closed position.

4. The gate as claimed in claim 1, wherein each of said gate elements comprises a substantially identically formed sheet metal shell.

5. The gate as claimed in claim 1, wherein said connection means includes welding means for connecting said sheet metal shells together.

6. The gate as claimed in claim 1, wherein said connection means includes snap connectors for connecting said substantially identically formed sheet metal shells.

7. The gate as claimed in claim 1, wherein said aperture region includes a recess on a front side of at least one of said elements in a region of the closure.

8. The gate according to claim 7, wherein said recess has a triangular cross section.

9. The gate according to claim 7, wherein at least one of said two adjacent elements has on a rear side and in a region of the closure a continuous recess, said hinge means being external of said continuous recess.

10. The gate as claimed in claim 1, wherein each said gate element comprises two formed sheet metal shells and connection means joining said sheet metal elements together to form a complete enclosure whereby to prevent entry of foreign matter into the interior of said joined elements.

11. The gate as claimed in claim 1, wherein said open aperture spacing is about 4 mm.

12. The gate according to claim 1, including:

a seal strip;

a gore in said depression associated with said tooth tip of a next adjacent gate element; and said seal strip being inserted into said gore at a rear end of the gate element associated with the tooth tip of the next adjacent gate element.

13. The gate according to claim 1, wherein said tooth tip comes to a point, and said front flank of the tooth-like projection is convexly curved and terminates at said point and has a substantially circular cross section, a center of a radius of curvature of said convexly curved front portion lying substantially in the respective pivot axis.

14. The gate according to claim 1, wherein at least one of said two adjacent elements has on a rear side and in a region of a closure a continuous recess, and said axis of said adjacent elements is located in the region of said rear recess.

15. A lift link gate for use with lateral guide tracks, including:

a plurality of tabular gate elements joined together by hingedly connected joint means with each said hingedly connected joint means extending about a horizontally extending pivot axis, each said gate element having a front face and a rear face;

guide means coupling said gate elements for sliding movement in said lateral guide tracks for guiding the gate in a vertical direction out of a vertically closed position along an arc path region into a horizontal direction to a horizontal open position;

in a first direction of movement, an upper edge of each gate element except a leading gate element includes a tooth-like projection substantially symmetrical relative to a gate center plane and having a tooth tip, a rear flank having a first surface and front flank having a second surface and third surface with an included angle therebetween ascending from said front face up to said tooth tip, said first surface of said rear flank descending form said tooth tip to said rear face of said gate element;

each said gate element at the lower edge thereof, except a last gate element, having at least one depression complementary to said projection of a next adjacent gate element for receiving therein the projection of said adjacent element said depression having a fourth surface and a fifth surface with an included angle therebetween and a sixth surface forming a second angle with said fifth surface, said fourth surface being complementary to said first surface and said fifth surface being complementary to and in a parallel condition with said third surface when said gate elements are axially aligned with each other;

each of said gate elements comprising two substantially identically formed sheet metal shells;

connection means for connecting said sheet metal shells together including inwardly directed members at each end of said substantially identically formed sheet metal shells and sealing members for forming a seal between said inwardly directed members at each end of said sheet metal shells; and an aperture region provided between said adjacent elements which aperture region includes an aperture spacing free of any other material to take up said aperture spacing precluding the wedging of a finger therein, said aperture spacing being formed by said second surface and said fifth surface which are in said parallel condition when said gate elements are axially aligned and in a non-parallel condition relative to each other upon pivoting of any two said two adjacent elements in said arc path region of the guide track, said aperture spacing being sufficient to preclude wedging of the finger therein for all positions of said gate elements relative to each other.

16. The lift link gate according to claim 15 wherein said at least one depression complementary to said projection of said next adjacent gate element and said tooth tip are symmetrical about said gate center plane.

17. The lift link gate according to claim 15, wherein said tooth tip includes sides extending from said tooth tip at said gate center plane towards said front face and said rear face, and said fourth surface and said fifth surface extending from said gate center plane towards said rear face and said front face, respectively.

* * * * *